US008870616B2

(12) United States Patent
McKinney

(10) Patent No.: US 8,870,616 B2
(45) Date of Patent: Oct. 28, 2014

(54) GLOW-IN-THE-DARK WETSUIT

(71) Applicant: Charles McKinney, Abilene, TX (US)

(72) Inventor: Charles McKinney, Abilene, TX (US)

( * ) Notice: Subject to any disclaimer, the term of this patent is extended or adjusted under 35 U.S.C. 154(b) by 102 days.

(21) Appl. No.: 13/646,047

(22) Filed: Oct. 5, 2012

(65) Prior Publication Data

US 2013/0164086 A1 Jun. 27, 2013

Related U.S. Application Data

(63) Continuation-in-part of application No. 13/333,126, filed on Dec. 21, 2011, now Pat. No. 8,662,949.

(51) Int. Cl.
*B63C 9/20* (2006.01)

(52) U.S. Cl.
USPC ..... 441/89; 362/108

(58) Field of Classification Search
USPC ..... 441/64, 89, 102; 362/103, 104, 108
See application file for complete search history.

(56) References Cited

U.S. PATENT DOCUMENTS

| | | | | |
|---|---|---|---|---|
| 4,578,042 | A | 3/1986 | Evert | |
| 5,421,287 | A | 6/1995 | Yonover | |
| 6,257,942 | B1 | 7/2001 | Groover | |
| 6,270,386 | B1 | 8/2001 | Visocekas | |
| 7,018,258 | B2 | 3/2006 | McLarty | |
| 7,189,128 | B2 | 3/2007 | Halliday | |
| 7,572,160 | B2 * | 8/2009 | Halliday | 441/64 |
| 8,460,043 | B2 * | 6/2013 | Halliday | 441/102 |
| 2008/0311805 | A1 | 12/2008 | Spears et al. | |
| 2010/0102065 | A1 | 4/2010 | Phelan | |
| 2010/0136862 | A1 | 6/2010 | Vick | |

* cited by examiner

*Primary Examiner* — Lars A Olson
(74) *Attorney, Agent, or Firm* — Buckingham Doolittle & Burroughs, LLC

(57) ABSTRACT

A glow in the dark wetsuit is disclosed that is visible in low-light conditions. The wetsuit comprises an outer surface visible in low-light conditions with at least one fastener for securing the wetsuit on a user. Preferably, the wetsuit comprises at least one glow in the dark element that is photoluminescent following sufficient exposure to a recharging source. The wetsuit insulates the user from cold water when submerged and protects the user from injury from marine life or from abrasions when diving in the water under any light condition. However, when the user is in or near the water at night, diving deep underwater, or in other low-light scenarios, the glow in the dark element radiates visible light enabling a companion, a dive buddy, or a rescuer to better visualize the user.

20 Claims, 5 Drawing Sheets

GLOW-IN-THE-DARK WETSUIT

CROSS-REFERENCE

This application is a continuation-in-part of patent application Ser. No. 13/333,126 filed Dec. 21, 2011.

FIELD OF THE INVENTION

This invention pertains generally to a glow in the dark wetsuit or lifesuit that is visible in low-light conditions, and more particularly to a durable conventional wetsuit or lifesuit having a phosphorescent portion that illuminates under low-light conditions.

BACKGROUND

Wetsuits are used by self-contained underwater breathing apparatus (SCUBA) divers, surfers, bodyboarders, snorkelers, water skiers, wake boarders, windsurfers, kayakers, jet skiers, and whitewater rafters, etc., to allow for comfortable and safe activities in cool or cold water. Wetsuits are essentially a form of thermal apparel that allows for a thin layer of water to form under an insulating material and be warmed by body heat. Lifesuits are survival gear for fishermen, coastguard and other users.

While traditional wetsuits and/or lifesuits may keep an individual warm and somewhat buoyant in the water, the wetsuits and/or lifesuits may not provide an obvious indication of the users' locations in the event of an emergency or even during a deep dive where the water and surrounding area is dark and/or murky. This is of particular concern during situations when an individual becomes lost at night or in dark, choppy waters, or is diving in deep water. The dark colors of conventional wetsuits and/or lifesuits may prevent rescuers, dive buddies, or other companions from easily spotting individuals, further delaying the rescue or identification process.

Therefore, a wetsuit and/or lifesuit that increases the visibility of a user would be advantageous. The proposed invention allows a dive buddy, a rescuer, or other companion to more easily visualize an individual floating in water in the dark, diving in deep water, or under any other low-light conditions. This increased visibility increases the likelihood of a successful retrieval, identification, and/or rescue of the user.

SUMMARY

Accordingly, the present invention overcomes the limitations of the prior art by providing a unique and useful glow in the dark wetsuit that increases the visibility of a user in the water especially under low-light conditions.

The following presents a simplified summary in order to provide a basic understanding of some novel embodiments described herein. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a wetsuit that is visible in low-light conditions. In one embodiment, the wetsuit comprises an outer surface visible in low-light conditions with at least one fastener for securing the wetsuit on a user. Preferably, the wetsuit comprises at least one glow in the dark element that is photoluminescent following sufficient exposure to a recharging source.

The wetsuit insulates the user from cold water when submerged and protects the user from injury from marine life or from abrasions when diving in the water under any light condition. However, when the user is in or near the water at night, diving deep underwater, or in other low-light scenarios, the glow in the dark element radiates visible light enabling a companion, a dive buddy, or a rescuer to better visualize the user. Further, the glow in the dark element is rechargeable following exposure to a recharging source. The wetsuit can be used to increase the user's safety in a wide variety of water related activities, namely, diving, boating, skiing, wakeboarding, fishing, and the like.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

Figure 1:
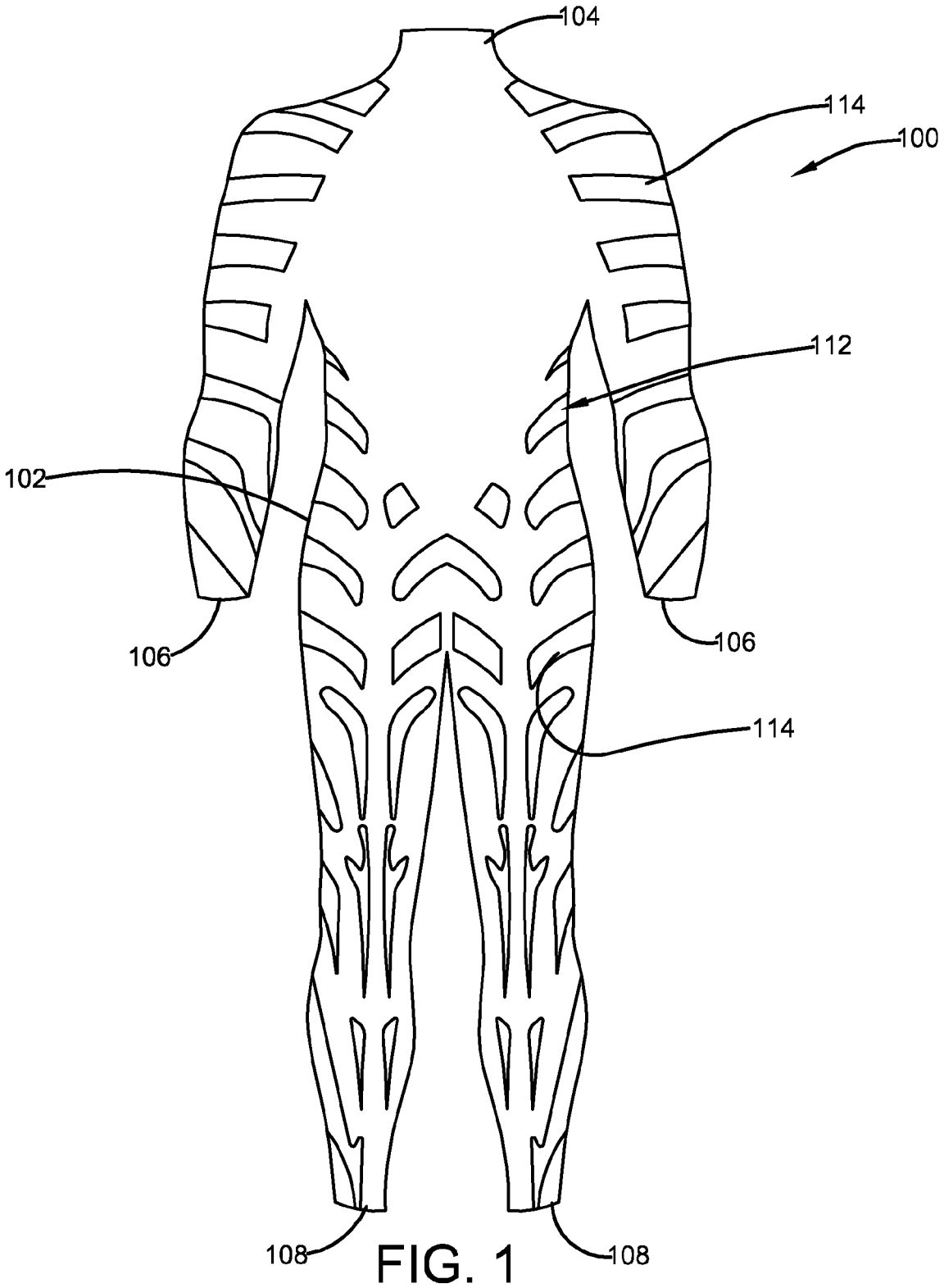
FIG. 1 illustrates a perspective view of a glow in the dark wetsuit in accordance with the disclosed architecture.

Safety of individuals on or near the water is of paramount importance to people who enjoy or engage in recreational and professional water sports and activities. Accordingly, the disclosed device is designed for individuals who desire a wetsuit that has increased visibility under low-light conditions. The device allows companions and rescue personal to better visualize individuals in or near the water, thereby increasing the likelihood of a successful retrieval or rescue if required, and also prevents accidents as passing boats and other watercraft are more likely to see the individual and not run them over.

Reference is now made to the drawings, wherein like reference numerals are used to refer to like elements throughout. In the following description, for purposes of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modifications, equivalents, and alternatives falling within the spirit and scope of the claimed subject matter.

The invention relates generally to a photoluminescent wetsuit for improved visibility of a user in or near the water under less than ideal visibility conditions such as at night. Referring initially to the drawings, FIG. 1 illustrates apparel or wetsuits 100 for use in water, such as a sleeveless vest, covering only the torso; a jacket which covers the torso and arms, with little to no coverage for the legs; a beavertail or bodysuit, which has a flap which closes over the crotch and attaches at the front with a fastener; a shorty or spring suit which covers the torso and has short sleeves and long or short legs; a long john or johnny suit which covers the torso and legs only; or a full suit or steamer which covers the torso and the full length of the arms and legs, or any other suitable apparel for use in the water as is known in the art.

The full wetsuit 100 comprises a torso portion 102, a neck opening 104, a pair of upper limb openings 106, and a pair of lower limb openings 108. Typically, the wetsuit 100 is comprised of multiple panels sewn together in an edge-to-edge relationship, but does not have to be, and the wetsuit 100 can be a single integral piece as well. The wetsuit 100 further comprises an inner surface (not shown) and an outer surface 112, wherein the outer surface 112 is visible under low-light conditions. Specifically, the outer surface 112 can comprise at lease one glow in the dark element 114. For example, at least 5-100% of the surface area of the outer surface 112 is covered by the glow in the dark element 114.

The wetsuit 100 would generally be constructed of a closed-cell foam such as cross linked polyethylene, neoprene, acrylonitrile butadiene rubber, and the like, though any other suitable material may be used to manufacture the wetsuit 100 as is known in the art without affecting the overall concept of the invention. Further, the wetsuit 100 may be manufactured to have a double-backed neoprene layer, such that the foam-rubber is sandwiched between two protective fabric outer layers, greatly increasing the tear-resistance of the material. In contrast, the wetsuit 100 may be manufactured to have a single-backed neoprene layer, which is more flexible than the double-backed layer.

The wetsuit 100 is worn by surfers, divers, windsurfers, canoeists, and others engaged in water sports, providing thermal insulation, abrasion resistance and increased buoyancy. Specifically, the insulation properties depend on bubbles of gas enclosed within the closed-cell foam material, which reduce its ability to conduct heat. The bubbles also give the wetsuit 100 a low density, providing buoyancy in water. Furthermore, the wetsuit 100 allows for a thin layer of water to form under the insulating material of the wetsuit 100 and be warmed by body heat from the user.

Furthermore, a wetsuit100 must have a snug fit to work efficiently; too loose a fit at water entry and exit points will allow water to escape from between the suit and the body, taking the body's heat with it. Additionally, cold water from the outside may enter the area between the wetsuit and the wearer's body in the same way. Flexible seals at the wetsuit 100 cuffs aid in preventing heat loss in this fashion. Further, wetsuits 100 come in different thicknesses depending on the conditions for which the wetsuit 100 is intended. The thicker the wetsuit 100, the warmer it will keep the wearer. Wetsuits 100 also offer significant protection from jellyfish, coral, sunburn and other hazards.

Additionally, the wetsuit 100 can include accessories, such as gloves, boots and hoods. These accessories offer additional insulation and environmental protection, and may also include pockets for holding small items and equipment, and knee-pads, to protect the knee area from abrasion and tearing, usually worn by working divers. These accessories can also be covered (completely or partially) in glow in the dark material.

Figure 2:
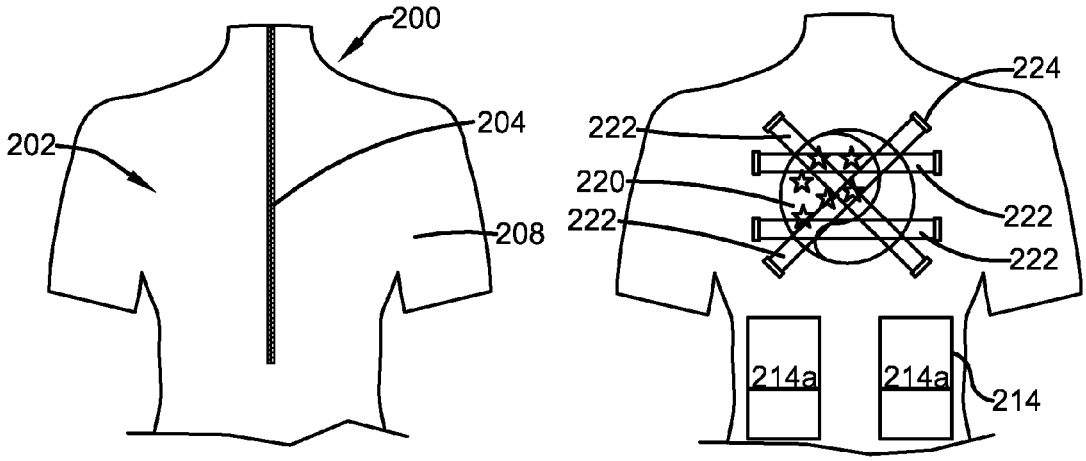
FIG. 2 illustrates a front and rear view of a glow in the dark wetsuit in accordance with the disclosed architecture.

When utilized, a user steps into the lower limb openings 108 of the wetsuit 100 and pulls the torso portion 102 up towards their head and then the user inserts their arms into the upper limb openings 106, which allows the wetsuit 100 to substantially encapsulates the user's body while the user's head, hands, and feet remain uncovered and unencumbered. Next, the at least one fastener 116 (as shown in FIG. 2) is used to keep the wetsuit 100 secured around the user. The at least one fastener 116 is connected to an opening in the back 118 (as shown in FIG. 2) of the wetsuit 100, and allows a user to open and close the opening. The at least one fastener 116 may comprise an attachment element, a zipper, a releasable closure mechanism, a buckle and straps, hook and loop fasteners, and the like, or any combination thereof as is known in the art.

Preferably, the at least one fastener 116 comprises a zipper mechanism for securing a torso opening (not shown) running perpendicularly down the back 118 of the wetsuit 100 from a neck opening 104 to approximately the middle of a user's back of the wetsuit 100. However, the zipper mechanism may be attached to any point on the wetsuit 100, such as on the side, by sewing, radio frequency welding, glue, adhesive, rivets, snaps, and the like, and by any other method known to one of skill in the art for attaching similar materials.

Furthermore, as the outer surface 112 has increased visibility under low-light conditions, either the material of the outer surface 112 and/or at least one glow in the dark element 114 having glow in the dark properties attached to the outer surface 112 are present in the invention. Glow in the dark properties allow for increased visibility of the wetsuit 100 once sufficiently charged by a light or other radiation source. For example, the at least one glow in the dark element 114 may be charged when exposed to a light source, for example, sunlight, ultra violet light, LED lights, incandescent lights, fluorescent lights, and the like. Once charged, the at least one glow in the dark element 114 will photoluminesce, or in other words, emit visible light.

Preferably, the wetsuit 100 will employ a plurality of the at least one glow in the dark element 114. The at least one glow in the dark element 114 may comprise a plurality of phosphorescent panels of any shape or design. The plurality of phosphorescent panels may be affixed or attached to the outer surface 112 by sewing, stitching, radio frequency welding, glue, adhesives, heat, or by any other method known to one skilled in the art. Additionally, the plurality of phosphorescent panels may be attached to the outer surface 112 in a variety of positions and orientations, such as to the front, back, and sides for example. Thus, at least 5-100% of the surface area of the outer surface 112 is covered by the glow in the dark element 114.

Further, the at least one glow in the dark element 114 may be silk screen sprayed or screen printed on the outer surface 112 or woven directly into the outer surface 112, or any other suitable method of applying the glow in the dark element. It may be advantageous to make use of a variety of different materials to produce a plurality of different colors to increase visibility of the wetsuit 100 under a variety of weather conditions and while diving underwater. For example, the at least one glow in the dark element 114 may contain different colors to aid in recognizing a user's dive buddy while diving. Thus, two divers may have wetsuits 100 that glow green, and two divers may have wetsuits 100 that glow red, etc.

Furthermore, any external portion or accessory of the wetsuit 100 may have photoluminescent properties. For example, the wetsuit 100 may have the at least one glow in the dark element 114 and further comprise glow in the dark decals, patches, bands, letters, numbers, pictures, zippers, straps, buckles, fasteners, strap positioning devices, attachment points, hoods, gloves, boots, and the like. Similarly, the material of the wetsuit 100 and/or the outer surface 112 may comprise a photoluminescent material.

The at least one glow in the dark element 114 of the present invention preferably comprises a photoluminescent compound. This allows the user to be more visible at night or under low-light conditions, as photoluminescent compounds emit visible light following sufficient exposure to a light or other comparable radiation source. Typically, the photoluminescent compound will comprise a phosphorescent material to produce the photoluminescence. For example, a phosphor such as copper or silver activated zinc sulfide may be incorporated into a plastic or other materials that make up the at least one glow in the dark element 114. Another preferred phosphor is europium activated strontium aluminate which is useful because it produces a more persistent and brighter visible light emission. However, these phosphors are not meant as a limitation as there are a wide variety of other phosphors and/or activators known to one skilled in the art that may be used as well.

The photoluminescence typically lasts for a period of time that depends on the length of exposure to the light source, the chemical composition of the phosphor and activator, and the type of radiation used for charging. After the phosphorescence abates, the user simply re-exposes the at least one glow in the dark element 114 to the light source. For example, the wetsuit 100 may recharge when left out in the sun. Products made with phosphorescent materials typically maintain their glow in the dark properties for several years as long as they are sufficiently recharged. Also, it is not uncommon for these materials to continue to emit light for up to ten hours or more with each charge.

Additionally, the invention is not limited to phosphor based photoluminescence as fluorescent materials may be used to produce photoluminescence for the wetsuit 100. Therefore, chemiluminescent materials which produce visible light through chemical reactions rather that from exposure to a light source may be used as the at least one glow in the dark element 114 as well. For example, commercially available glow in the dark light sticks, which are activated by removing or cracking a barrier between a plurality of reactants, may be used in the at least one glow in the dark element 114 instead of or in conjunction with a phosphor based photoluminescent material to give off light. It may be advantageous to make use of a variety of different materials to produce a plurality of different colors and/or to have a plurality of different glow time periods. Similarly, the wetsuit 100 may comprise reflective elements (not shown) in conjunction with the photoluminescent and/or chemiluminescent materials to increase visibility of the wetsuit 100 under a variety of weather conditions.

Next, the at least one glow in the dark element 114 may be manufactured into a variety of desired shapes or elements. For example, the plurality of phosphorescent panels may comprise a phosphor powder or pigment mixed with a polymer to produce a flexible panel that may be attached to the outer surface 112. These processes are not meant as a limitation as a phosphorescent material may be combined with the at least one glow in the dark element 114 by painting, dying, lining, coating, extruding, embedding, casting, dipping, or by any other method of manufacture known to one of skill in the art.

Figure 2A:
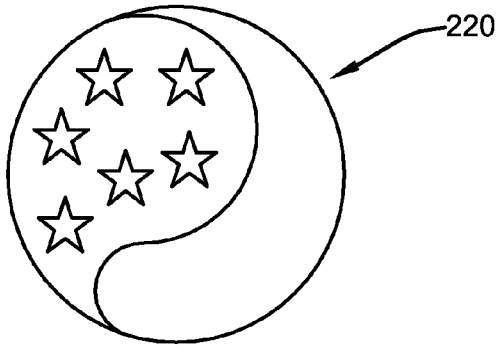
FIG. 2A illustrates a removable decorative insert for use in conjunction with the glow in the dark wetsuit in accordance with the disclosed architecture.

In another embodiment as shown in FIGS. 2 and 2A, a wetsuit 200 comprises an outer surface 202. The wetsuit 200 is held in place on a user by a zipper mechanism 204 on the back 208 of the wetsuit 200. At least one glow in the dark element 214, a phosphorescent panel 214(*a*) for example, is attached to the outer surface 202. A plurality of securing bands 222 are used to hold a decorative element 220 in place on the front of the wetsuit 200. The plurality of securing bands 222 typically comprise a transparent or photoluminescent material and are attached to the outer surface 202, as discussed supra. Each of the plurality of securing bands 222 may further comprise an adjusting element 224 for selectively loosening and tightening the plurality of securing bands 222. While the embodiment in FIG. 2 illustrates four of the plurality of securing bands 222, two substantially horizontal and two substantially diagonal, any number may be employed in any orientation without deviating from the scope of the invention. Additionally, any other method of securing the decorative element 220 to the outer surface 202, such as with webbing, cords, mesh, and the like may be used.

The decorative element 220 may comprise any design or shape that the user desires that may be held in place by the plurality of securing bands 222. Also, the decorative element 220 may comprise a fluorescent material, a photoluminescent material, or both. To attach the decorative element 220, the user simply loosens the plurality of securing bands 222 with the adjusting element 224, slides the decorative element 220 in place between the plurality of securing bands 222 and the outer surface 202, and then tightens the plurality of securing bands 222 with the adjusting element 224. Additionally, the plurality of securing bands 222 may be photoluminescent, transparent, translucent or may have an opening (not shown) for a transparent or translucent portion (not shown) for accepting a tube or panel of chemiluminescent material such as a glow stick.

Figure 3:
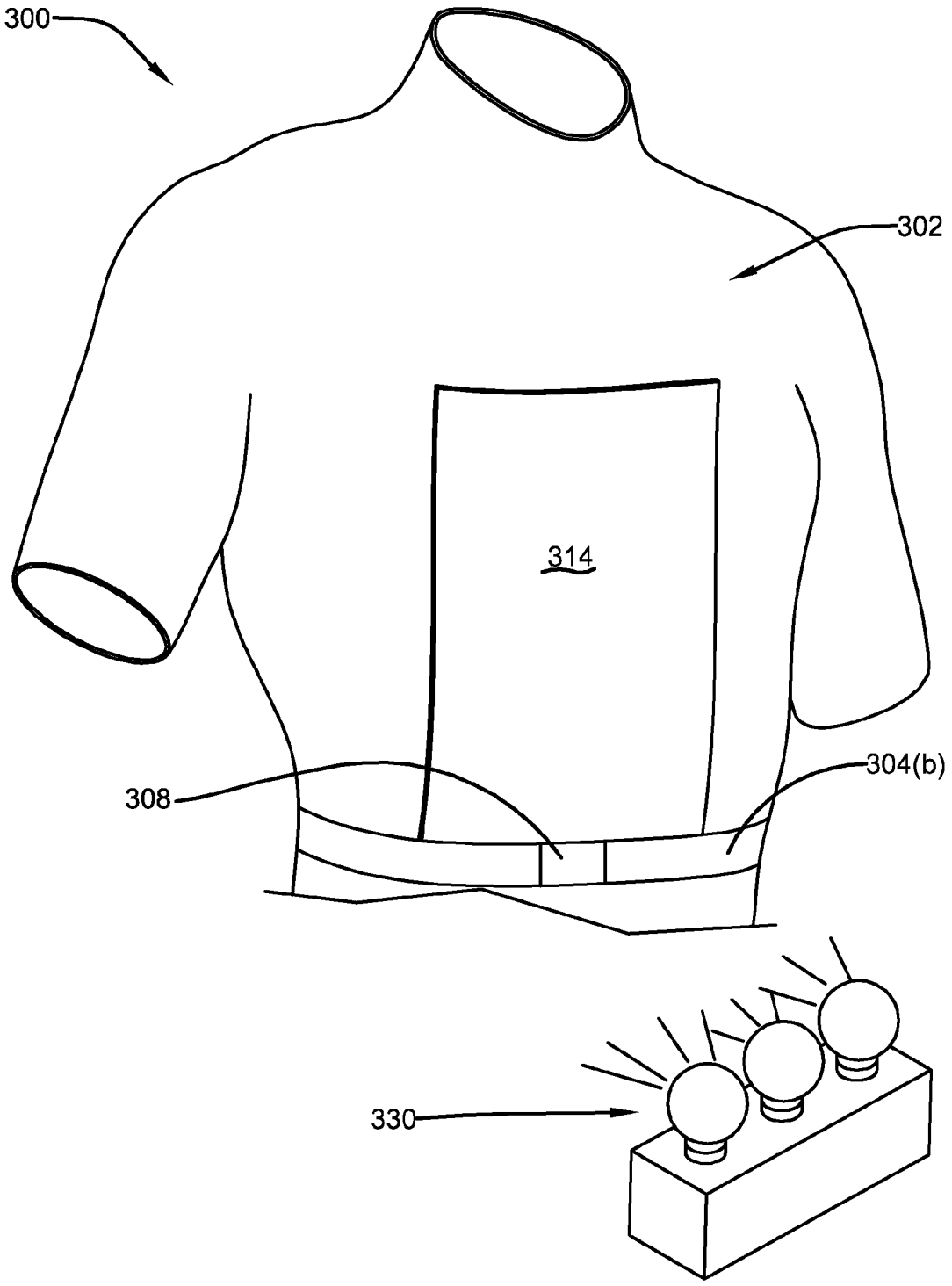
FIG. 3 illustrates a perspective view of a glow in the dark wetsuit in accordance with the disclosed architecture.

FIG. 3 illustrates an embodiment of a wetsuit 300 suitable for storage without a naturally occurring recharging source such as sunlight. Often, wetsuits are stored out of sight and are only removed from storage when needed. Therefore, while still rechargeable by direct sunlight, the wetsuit 300 may also comprise a recharging source 330. The recharging source 330 may provide an artificial or man made light or radiation source so that the wetsuit 300 remains charged and ready for use even when stored away from sunlight or other radiation sources. The recharging source 330 may comprise an ultraviolet light source, a black light, a light-emitting diode, a visible light source, a battery powered flashlight, and the like. Similarly, the recharging source 330 may comprise elements that emit radiation such as tritium and promethium, for example.

The recharging source 330 may or may not attach to the wetsuit 300 as desired. Optionally, the recharging source 330 may simply be clipped on or otherwise affixed anywhere to an outer surface 302 of the wetsuit 300. For example, the wetsuit 300 may comprise a dive belt or strap 304(*b*) with a buckle mechanism 308. The recharging source 330 may then clip on or otherwise attach to the belt or strap 304(*b*). The recharging source 330 is used to recharge an at least one glow in the dark element 314, such as a fluorescent panel or other portion of the wetsuit 300. Alternatively, the recharging source 330 may simply remain where the wetsuit 300 is stored, for example in a cabinet or locker.

Figure 4:
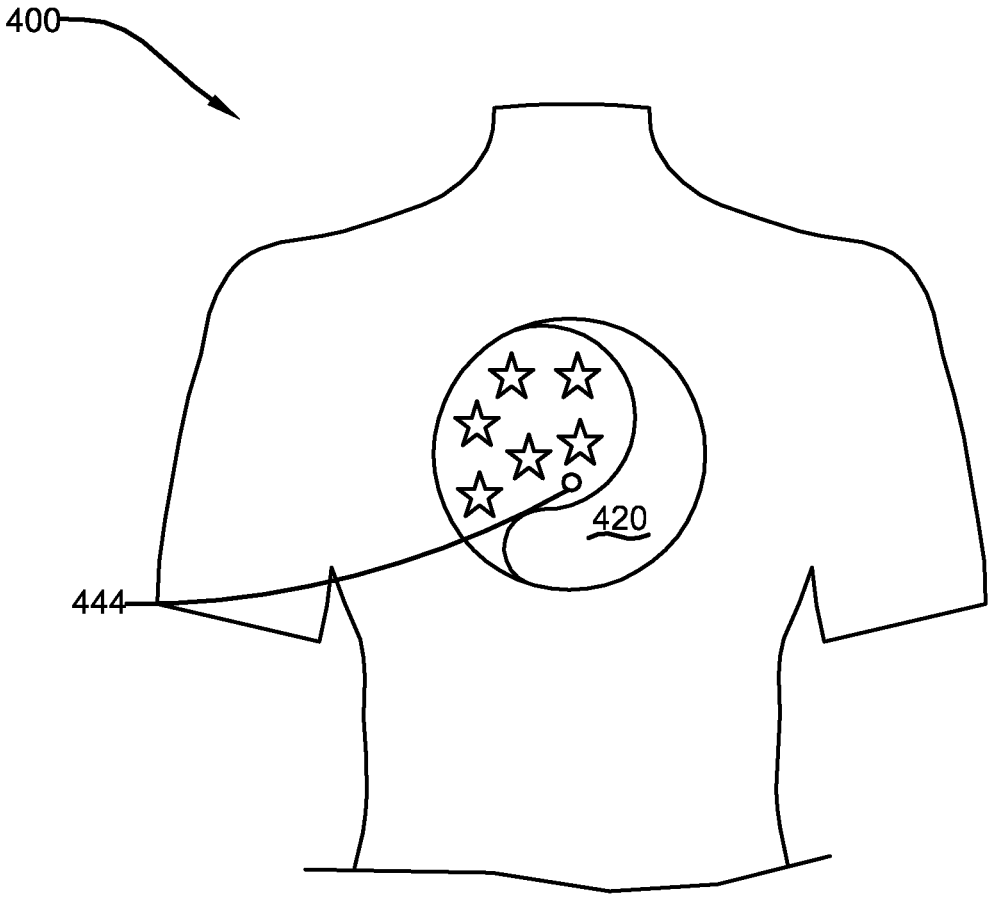
FIG. 4 illustrates a rear view of a glow in the dark wetsuit with an attachable decorative element in accordance with the disclosed architecture.
Figure 4A:
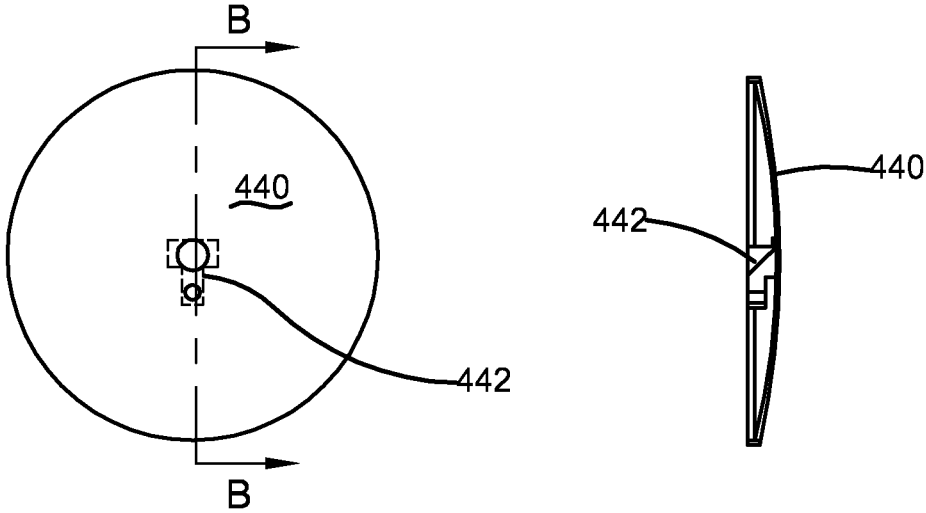
FIG. 4A illustrates a side view of the attachable decorative element of the glow in the dark wetsuit in accordance with the disclosed architecture.

FIG. 4 illustrates an embodiment of a wetsuit 400 that is customizable in design. The front of the wetsuit 400 comprises an attachment surface 440 for attaching a decorative element 420. As illustrated in FIG. 4A, the attachment surface 440 is typically a convex disk of material, plastic for example, that is sewn on or otherwise attached, as discussed supra, to the wetsuit 400. In addition, the attachment surface 440 may optionally be affixed to the wetsuit 400 with a mechanical fastener 444, such as a screw or rivet. Furthermore, the attachment surface further comprises a T-slot 442 for accepting a T-peg 446 (as shown in FIG. 5).

Figure 5A:
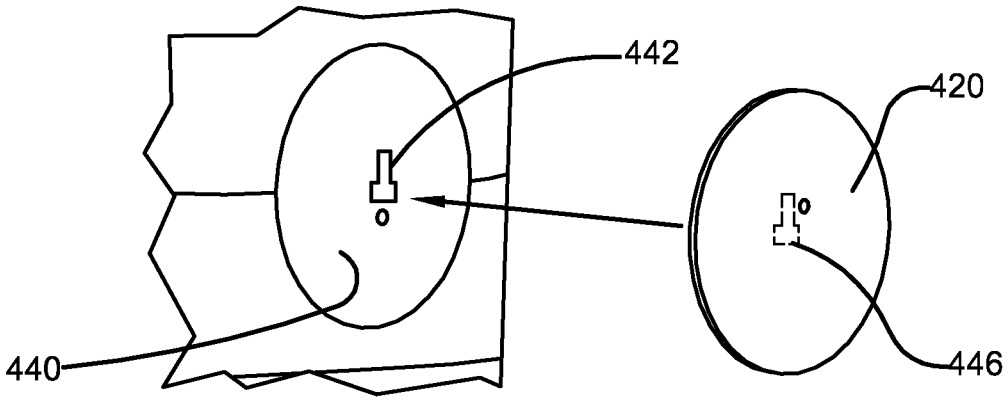
FIGS. 5A-C illustrate a perspective view of the decorative element with a T-peg attachment mechanism in accordance with the disclosed architecture.
Figure 5B:
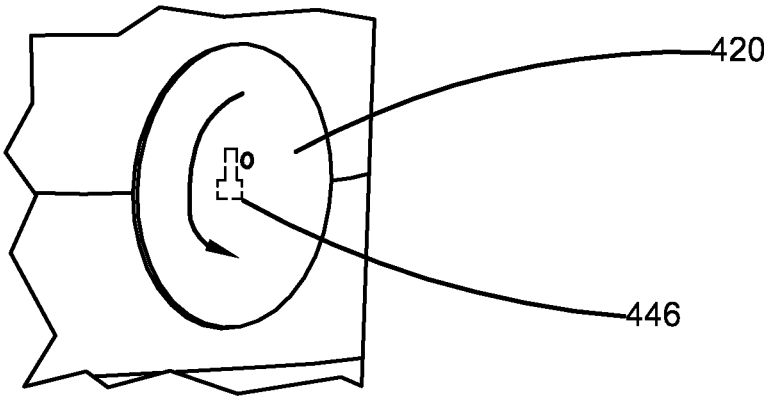
Figure 5C:
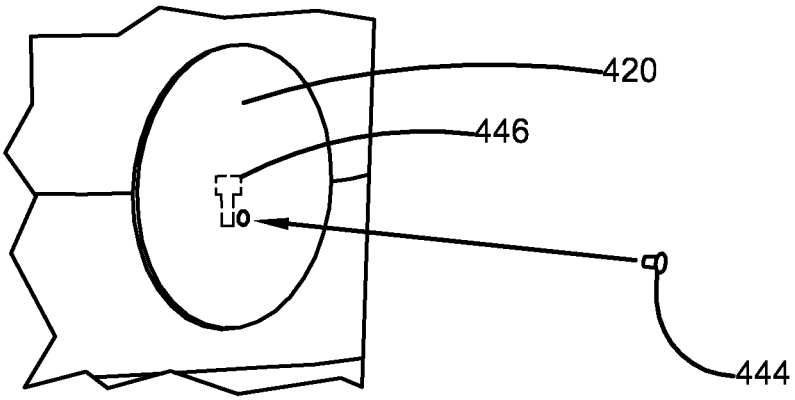

A user may select the decorative element 420 available that is desirable. The decorative element 420 may comprise any design that the user desires, such as a spider shape, a cross, a directional arrow, and a picture for example. As illustrated in FIGS. 5A-C, the decorative element 420 comprises the T-peg 446 on the back of the decorative element 420. The T-peg 446 is orientated upside down on the decorative element 420 as compared to the T-slot 442 in the attachment surface 440. To attach the chosen decorative element 420 to the wetsuit 400, the user inserts the T-peg 446 into the T-slot 442. In this position, the decorative element 420 will be orientated upside down on the wetsuit 400. The decorative element 420 is then rotated substantially 180 degrees so that it is now upright in orientation. However, the T-peg 446 has rotated substantially 180 degrees as well and in now temporarily locked in position in the T-slot 442. To remove the decorative element 420, the process is simply reversed.

What has been described above includes examples of the disclosed device. It is, of course, not possible to describe every conceivable combination of components and/or methodologies, but one of ordinary skill in the art may recognize that many further combinations and permutations are possible. Accordingly, the novel device is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An apparel for use in water comprising:

a torso portion, a neck opening, a pair of upper limb openings, and a pair of lower limb openings, and wherein the apparel comprises:

an inner surface; and an outer surface, wherein the outer surface comprises at least one glow in the dark element; and wherein the at least one glow in the dark element is attached to the outer surface via a plurality of securing bands which hold the at least one glow in the dark element in place on a front of the apparel; and wherein the plurality of securing bands comprise a photoluminescent material and are attached to the outer surface.

2. The apparel of claim 1, wherein the apparel comprises at least one of the following: a bodysuit, a spring suit, a johnny suit, and a full suit.

3. The apparel of claim 1, wherein the outer surface comprises at least one of the following materials: neoprene or closed-cell acrylonitrile butadiene rubber.

4. The apparel of claim 1, further comprising an opening disposed on a back side of the apparel and at least one fastener connected to the opening to open and close the opening.

5. The apparel of claim 1, further comprising at least one of the following accessories: a glove, a boot, or a hood; and wherein the at least one accessory comprises at least one glow in the dark element.

6. The apparel of claim 1, wherein the glow in the dark element comprises a photoluminescent material, which covers at least 5-100% of surface area of the outer surface.

7. The apparel of claim 6, wherein the outer surface is lined, dyed, painted, silk screen sprayed, woven, or coated with a layer of a photoluminescent material.

8. The apparel of claim 7, wherein the at least one glow in the dark element comprises one of the following materials: zinc sulfide, strontium aluminate.

9. The apparel of claim 8, wherein the at least one glow in the dark element fluoresces a plurality of colors.

10. A wetsuit comprising:

an inner surface;

an outer surface comprising at least one glow in the dark element; and an opening disposed on a back side of the wetsuit and at least one fastener connected to the opening to open and close the opening; and wherein the outer surface further comprises an attachment surface and a detachable photoluminescent decorative element; and wherein the detachable photoluminescent decorative element comprises a T-peg for inserting into a T-slot in the attachment surface.

11. The wetsuit of claim 10, wherein the glow in the dark element comprises a photoluminescent material, which covers at least 5-100% of surface area of the outer surface.

12. The wetsuit of claim 11, wherein the outer surface is lined, dyed, painted, silk screen sprayed, woven, or coated with a layer of a photoluminescent material.

13. The wetsuit of claim 10, wherein the glow in the dark element comprises a phosphor.

14. The wetsuit of claim 10, wherein the at least one glow in the dark element comprises at least one of the following: a patch, a decal, a strap, a panel, a portion of the outer surface.

15. The wetsuit of claim 10, wherein the at least one glow in the dark element comprises one of the following materials: zinc sulfide, strontium aluminate.

16. The wetsuit of claim 10, wherein the at least one glow in the dark element fluoresces a plurality of colors.

17. A wetsuit comprising:

an inner surface;

an outer surface comprised of a rechargeable phosphorescent compound;

a recharging source; and an opening disposed on a back side of the wetsuit and at least one fastener connected to the opening to open and close the opening: and wherein the at least one glow in the dark element is attached to the outer surface via a plurality of securing bands which hold the at least one glow in the dark element in place on a front of the apparel; and wherein the plurality of securing bands comprise a photoluminescent material and are attached to the outer surface.

18. The wetsuit of claim 17, wherein the recharging source comprises an light emitting diode (LED), a visible light source, an ultraviolet source, or a black ultraviolet source.

19. The wetsuit of claim 17, further comprising a chemiluminescent element and a reflective element attached to the outer surface.

20. The wetsuit of claim 17, wherein the phosphorescent compound is rechargeable with a radioactive source.

* * * * *